US006895794B2

(12) United States Patent
Yamamoto et al.

(10) Patent No.: US 6,895,794 B2
(45) Date of Patent: May 24, 2005

(54) ROLLING MILL AND ROLLING METHOD

(75) Inventors: Mikio Yamamoto, Hiroshima (JP); Toshihiro Usugi, Hiroshima (JP); Keizou Takemura, Hiroshima (JP); Akira Kaya, Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 6 days.

(21) Appl. No.: 10/192,700

(22) Filed: Jul. 11, 2002

(65) Prior Publication Data

US 2003/0019271 A1 Jan. 30, 2003

(30) Foreign Application Priority Data

Jul. 30, 2001 (JP) ..... 2001-228993
Oct. 10, 2001 (JP) ..... 2001-312176

(51) Int. Cl.[7] ..... B21B 31/18
(52) U.S. Cl. ..... 72/245; 72/237; 72/247
(58) Field of Search ..... 72/245, 248, 237, 72/247

(56) References Cited

U.S. PATENT DOCUMENTS 6,151,943 A 11/2000 Nihei et al.
6,519,994 B1 * 2/2003 Quambusch ..... 72/237

FOREIGN PATENT DOCUMENTS

JP 2001-113308 4/2001
TW 248536 6/1995

* cited by examiner

*Primary Examiner*—Lowell A. Larson
(74) *Attorney, Agent, or Firm*—Birch, Stewart, Kolasch & Birch, LLP

(57) ABSTRACT

A screw down cylinder, an upper backup roll chock, and an upper work roll chock are pressed against an upper crosshead by hydraulic cylinders, and an upper roll cross mechanism is actuated, whereby the upper backup roll chock (upper backup roll), the upper work roll chock (upper work roll), and the screw down device (screw down cylinders) can be synchronously moved in the same direction via the upper crosshead.

12 Claims, 10 Drawing Sheets

ROLLING MILL AND ROLLING METHOD

The entire disclosure of Japanese Patent Application No. 2001-228993 filed on Jul. 30, 2001 and Japanese Patent Application No. 2001-312176 filed on Oct. 10, 2001 including specification, claims, drawings and summary is incorporated herein by reference in its entirety.

BACKGROUND OF THE INVENTION

1. Field of the Invention

This invention relates to a rolling mill and a rolling method for rolling a strip material or a bar material, which passes through upper and lower rolling rolls, to a predetermined thickness.

2. Description of Related Art

FIG. 10 schematically shows a conventional four high cross rolling mill.

In the conventional four high cross rolling mill, as shown in FIG. 10, upper and lower work roll chocks 002 and 003 are supported inside a housing 001. Shaft portions of upper and lower work rolls 004 and 005 are rotatably supported by the upper and lower work roll chocks 002 and 003, respectively, and the upper work roll 004 and the lower work roll 005 are disposed so as to be opposed to each other. Upper and lower backup roll chocks 006 and 007 are supported above and below the upper and lower work roll chocks 002 and 003. Shaft portions of upper and lower backup rolls 008 and 009 are rotatably supported by the upper and lower backup roll chocks 006 and 007, respectively. The upper backup roll 008 and the upper work roll 004 are opposed to each other, while the lower backup roll 009 and the lower work roll 005 are opposed to each other. A screw down device 010 for imposing a rolling load on the upper work roll 004 via the upper backup roll chock 006 and the upper backup roll 008 is provided in an upper portion of the housing 001.

Upper crossheads 011 and 012 for horizontally supporting the upper backup roll chock 006 and the upper work roll chock 002 are provided in the upper portion of the housing 001 and positioned on an entry side and a delivery side of the housing 001. The upper crossheads 011, 012 are horizontally movable by roll cross mechanisms 013, 014. Lower crossheads 015 and 016 for horizontally supporting the lower backup roll chock 007 and the lower work roll chock 003 are provided in a lower portion of the housing 001 and positioned on the entry side and the delivery side of the housing 001. The lower crossheads 015, 016 are horizontally movable by roll cross mechanisms 017, 018.

Thus, when rolling is performed, a strip S is fed from the entry side of the housing 001, and passed between the upper work roll 004 given a predetermined load by the screw down device 010 and the lower work roll 005, whereby the strip S is rolled. The rolled strip S is delivered from the delivery side and supplied to a subsequent step.

The roll cross mechanisms 013, 014, 017, 018 are actuated before or during rolling, whereby the upper chocks 002, 006 and the lower chocks 003, 007 are moved in directions different from each other via the crossheads 011, 012, 015, 016. As a result, the upper work roll 004 and upper backup roll 008, and the lower work roll 005 and lower backup roll 009 are turned in opposite directions about a roll center so that their rotation axes will cross each other and the angle of their crossed axes will be set at a predetermined angle. By so doing, the crown of the strip is controlled.

When screw down cylinders impose a rolling load on an upper work roll in an ordinary rolling mill, it is desired that the center of the screw down cylinder presses downward a proper position of an upper backup roll chock corresponding to the shaft center of an upper backup roll (upper work roll). With the conventional cross rolling mill described above, the roll cross mechanisms 013, 014, 017, 018 are actuated, whereby the upper work roll 004 and upper backup roll 008, and the lower work roll 005 and lower backup roll 009 are caused to cross at a predetermined angle in order to control the strip crown. By so doing, however, the center $O_A$ of the screw down device 010 and the shaft center $O_R$ of the upper backup roll 008 (upper work roll 004) are displaced from each other upstream or downstream in a transport direction (offset amount F). Thus, the screw down device 010 cannot press the proper position of the upper backup roll chock 006 corresponding to the shaft center $O_R$ of the upper backup roll 008.

If a pressing force acts on a position displaced from the proper position of the upper backup roll chock 006 corresponding to the shaft center $O_R$ of the upper backup roll 008 by the action of the screw down device 010, a tipping moment occurs in the upper backup roll chock 006. As a result, the upper work roll 004 cannot apply a proper rolling load to the strip S, so that stable rolling does not take place, decreasing the accuracy of rolling. Because of the tipping moment occurring in the upper backup roll chock 006, one-sided contact occurs between the screw down device 010 and the upper backup roll chock 006, causing partial wear to shorten the life of the screw down device 010.

SUMMARY OF THE INVENTION

The present invention has been accomplished to solve the above problems. Its object is to provide a rolling mill and a rolling method which perform stable rolling while imparting a screw down force properly to a rolling roll to increase the accuracy of rolling and prevent a decrease in life.

As an aspect of the present invention, there is provided a rolling mill comprising a housing, upper and lower rolling rolls rotatably supported by the housing via roll chocks, screw down means provided in an upper portion of the housing and adapted to apply a predetermined pressure to the rolling roll, roll moving means for moving the roll chocks in horizontal planes, and screw down moving means for moving the screw down means in a horizontal plane.

According to this aspect, even when the rolling roll is moved, the screw down means can constantly apply a predetermined pressure to a predetermined position of the rolling roll. In this manner, a screw down force is properly imparted to the rolling roll, and stable rolling is performed. Thus, rolling accuracy can be increased, and a decrease in the life of the screw down means can be prevented.

In the rolling mill, the roll moving means and the screw down moving means may act as a single synchronous moving means, and the roll chocks and the screw down means can be synchronously moved by the synchronous moving means. Thus, the accuracy of the position to which the members are moved can be increased, and the structure can be simplified.

In the rolling mill, the screw down means may be hydraulic cylinders, and the hydraulic cylinders may be suspended from and supported by the upper portion of the housing so as to be movable in the horizontal plane. Thus, the screw down means can be supported by a simple structure so as to be movable in the horizontal plane.

The rolling mill may further include balance cylinders provided on the housing for pushing up the upper roll chocks, the upper rolling roll, and the screw down means to bear their weights. Thus, the weights of the respective devices can be canceled out by the balance cylinders, so that a decrease in the rolling accuracy of a strip material can be prevented.

The rolling mill may further include first balance cylinders provided on the housing for pushing up the upper roll chocks and the upper rolling roll to bear their weights, and second balance cylinders provided on the housing for suspending the screw down means to bear its weight. Thus, the weights of the roll chocks and rolling roll are canceled out by the first balance cylinders, while the weight of the screw down means is canceled out by the second balance cylinders. In this manner, the weights of the respective devices are canceled out separately, so that a decrease in the rolling accuracy of the strip material can be prevented reliably.

The rolling mill may be a cross rolling mill for moving the roll chocks forward and rearward in a transport direction of a strip material, the roll chocks supporting the upper and lower rolling rolls, thereby causing central axes of the rolls to cross each other, and wherein roll cross means for moving the roll chocks to cross the upper and lower rolling rolls may comprise the roll moving means and the screw down moving means. Thus, even when the rolling roll makes a crossing movement, the screw down means can constantly apply a predetermined pressure to a shaft center position of the rolling roll. As a result, a screw down force is properly imparted to the rolling roll, and stable rolling can be performed.

In the rolling mill, the roll cross means may be a crosshead for supporting the roll chocks and the screw down means so as to be movable in the transport direction of the strip material. Thus, the crossing angle can be set with high accuracy by a simple structure.

In the rolling mill, the roll cross means may include a mechanical moving mechanism provided on one of an entry side and a delivery side of the strip material in the roll chocks, and a hydraulic moving mechanism provided on the other of the entry side and the delivery side. Thus, the crossing angle can be set with high accuracy by the mechanical moving mechanism, and highly efficient rolling can be performed with mill vibrations being suppressed by the hydraulic moving mechanism.

In the rolling mill, the rolling rolls may include upper and lower work rolls rotatably supported in the housing via work roll chocks and opposed to each other, and upper and lower backup rolls rotatably supported in the housing via backup roll chocks and opposed to and contacted with the upper and lower work rolls, and the roll cross means may move the work roll chocks and the backup roll chocks by the crosshead. Thus, the roll cross means moves the screw down means, work roll chocks and backup roll chocks via the crosshead, so that the accuracy of the position, to which the members are moved, can be increased.

The rolling mill may be a shift rolling mill for shifting the upper and lower rolling rolls in a roll axis direction, and wherein the roll moving means and the screw down moving means may be a shift cylinder for moving the roll chocks and the screw down means in the roll axis direction. Thus, even when the rolling roll makes a shifting movement, the screw down means can constantly apply a predetermined pressure to a shaft center position of the rolling roll. As a result, a screw down force is properly imparted to the rolling roll, and stable rolling can be performed.

The rolling mill may be an offset rolling mill in which the rolling rolls are composed of upper and lower work rolls rotatably supported in the housing via work roll chocks and opposed to each other, and upper and lower backup rolls rotatably supported in the housing via backup roll chocks and opposed to and contacted with the upper and lower work rolls; the backup rolls opposed to and contacted with the work rolls are slightly displaced in a transport direction of a strip material; and wherein the roll moving means and the screw down moving means may be offset cylinders for moving the roll chocks and the screw down means in the transport direction of the strip material. Thus, even when the rolling roll makes an offset movement, the screw down means can constantly apply a predetermined pressure to a shaft center position of the rolling roll. As a result, a screw down force is properly imparted to the rolling roll, and stable rolling can be performed.

According to another aspect of the present invention, there is provided a rolling method which applies a predetermined pressure onto an upper rolling roll by screw down means provided in an upper portion of a housing, thereby rolling a strip material passing between the upper rolling roll and a lower rolling roll, further comprising moving the screw down means in synchronism with movement of the rolling roll when the rolling roll is moved in a horizontal plane during rolling of the strip material.

According to this aspect, the screw down means can constantly apply a predetermined pressure to a predetermined position of the rolling roll. In this manner, a screw down force is properly imparted to the rolling roll, and stable rolling is performed. Thus, rolling accuracy can be increased, and a decrease in the life of the screw down means can be prevented.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PRESENT INVENTION

Preferred embodiments of the present invention will now be described in detail with reference to the accompanying drawings, which in no way limit the invention.

First Embodiment

Figure 1:
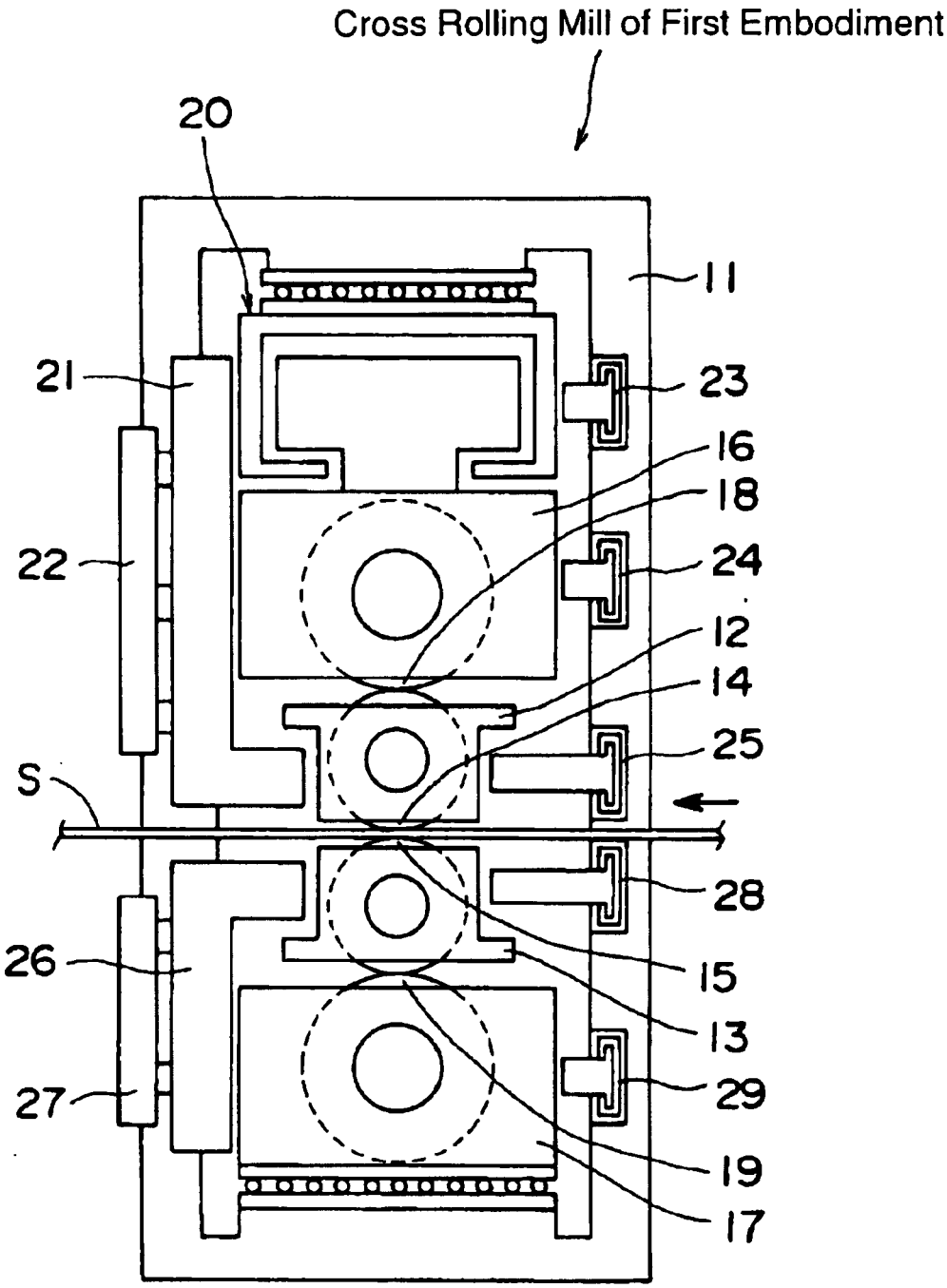
FIG. 1 is a schematic view of a cross rolling mill as a rolling mill according to a first embodiment of the present invention.

A four high cross rolling mill as a rolling mill according to a first embodiment is briefly described. As shown in FIG. 1, upper and lower work roll chocks 12 and 13 are supported in a housing 11. Shaft portions of upper and lower work rolls 14 and 15 are rotatably supported by the upper and lower work roll chocks 12 and 13, respectively, and the upper work roll 14 and the lower work roll 15 are opposed to each other. Upper and lower backup roll chocks 16 and 17 are supported above and below the upper and lower work roll chocks 12 and 13. Shaft portions of upper and lower backup rolls 18 and 19 are rotatably supported by the upper and lower backup roll chocks 16 and 17, respectively. The upper backup roll 18 and the upper work roll 14 are opposed to each other, while the lower backup roll 19 and the lower work roll 15 are opposed to each other. A screw down device 20 for imposing a rolling load on the upper work roll 14 via the upper backup roll 18 is provided in an upper portion of the housing 11.

An upper crosshead 21 for supporting the screw down device 20, upper work roll chock 12, and upper backup roll chock 16 is provided in the upper portion of the housing 11 and positioned unilaterally on a delivery side of the housing 11. The upper crosshead 21 is horizontally movable by an upper roll cross mechanism 22. Hydraulic cylinder mechanisms 23, 24, 25 for pushing the screw down device 20, upper work roll chock 12, and upper backup roll chock 16 are provided in the upper portion of the housing 11 and positioned unilaterally on an entry side of the housing 11. A lower crosshead 26 for supporting the lower work roll chock 13 and lower backup roll chock 17 is provided in a lower portion of the housing 11 and positioned unilaterally on the delivery side of the housing 11. The lower crosshead 26 is horizontally movable by a lower roll cross mechanism 27. Hydraulic cylinder mechanisms 28, 29 for pushing the lower work roll chock 13 and lower backup roll chock 17 are provided in the lower portion of the housing 11 and positioned unilaterally on the entry side of the housing 11.

Thus, when a strip S is fed from the entry side of the housing 11 and a predetermined load is imposed by the screw down device 20, the strip S is subjected to a rolling load when it passes between the upper work roll 14 and the lower work roll 15, whereby it is rolled to a predetermined plate thickness. At this time, the hydraulic cylinder mechanisms 23, 24, 25, 28, 29 and the roll cross mechanisms 22, 27 are actuated to move the upper chocks 12, 16 and the lower chocks 13, 17 in different directions via the cross heads 21, 26. As a result, the upper work roll 14 and upper backup roll 18 and the lower work roll 15 and lower backup roll 19 have their rotation axes crossed, and the angle of their crossed axes is set at a predetermined angle to control the strip crown.

According to the present embodiment, when the crossing angle between the upper work roll 14 and upper backup roll 18 and the lower work roll 15 and lower backup roll 19 is set by the roll cross mechanisms 22, 27, the screw down device 20 is synchronously moved in the same direction together with the upper chocks 12, 16 (upper work roll 14 and upper backup roll 18). By this measure, the screw down device 20 presses a proper position of the upper backup roll chock 16 corresponding to the shaft center of the upper backup roll 18 to carry out stable rolling constantly.

Figure 2:
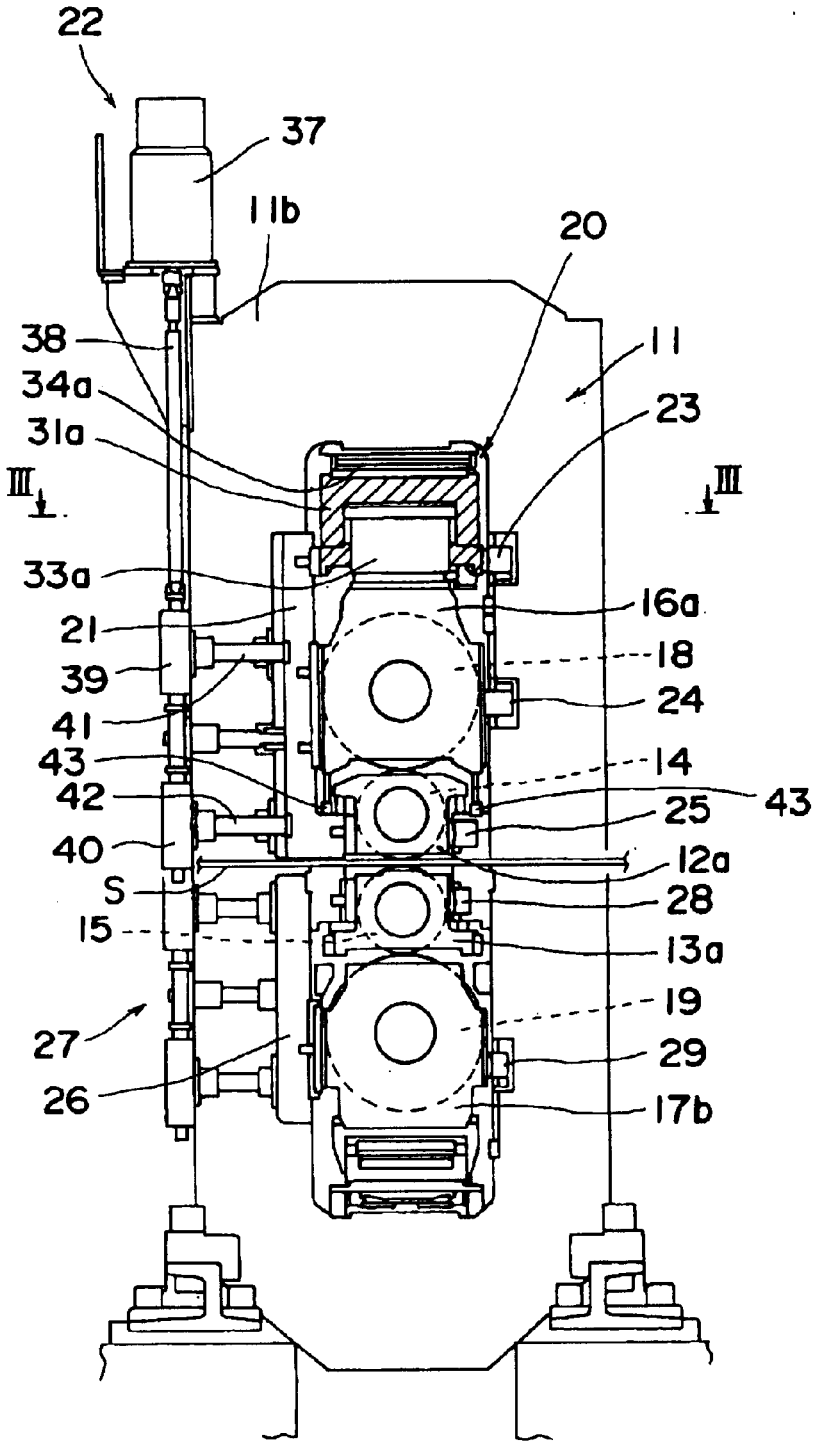
FIG. 2 is a partial cutaway side view of the cross rolling mill of the first embodiment.
Figure 3:
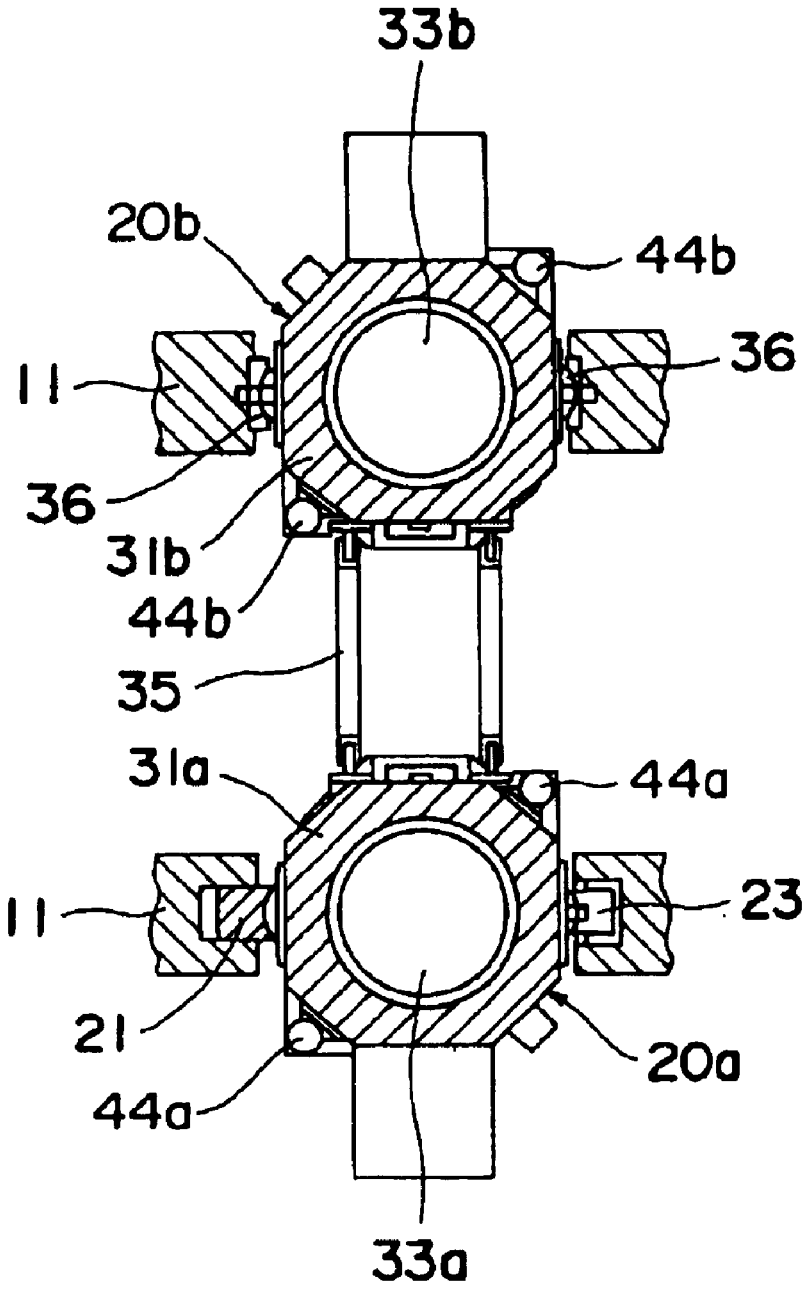
FIG. 3 is a sectional view taken along line III—III of FIG. 2.
Figure 4:
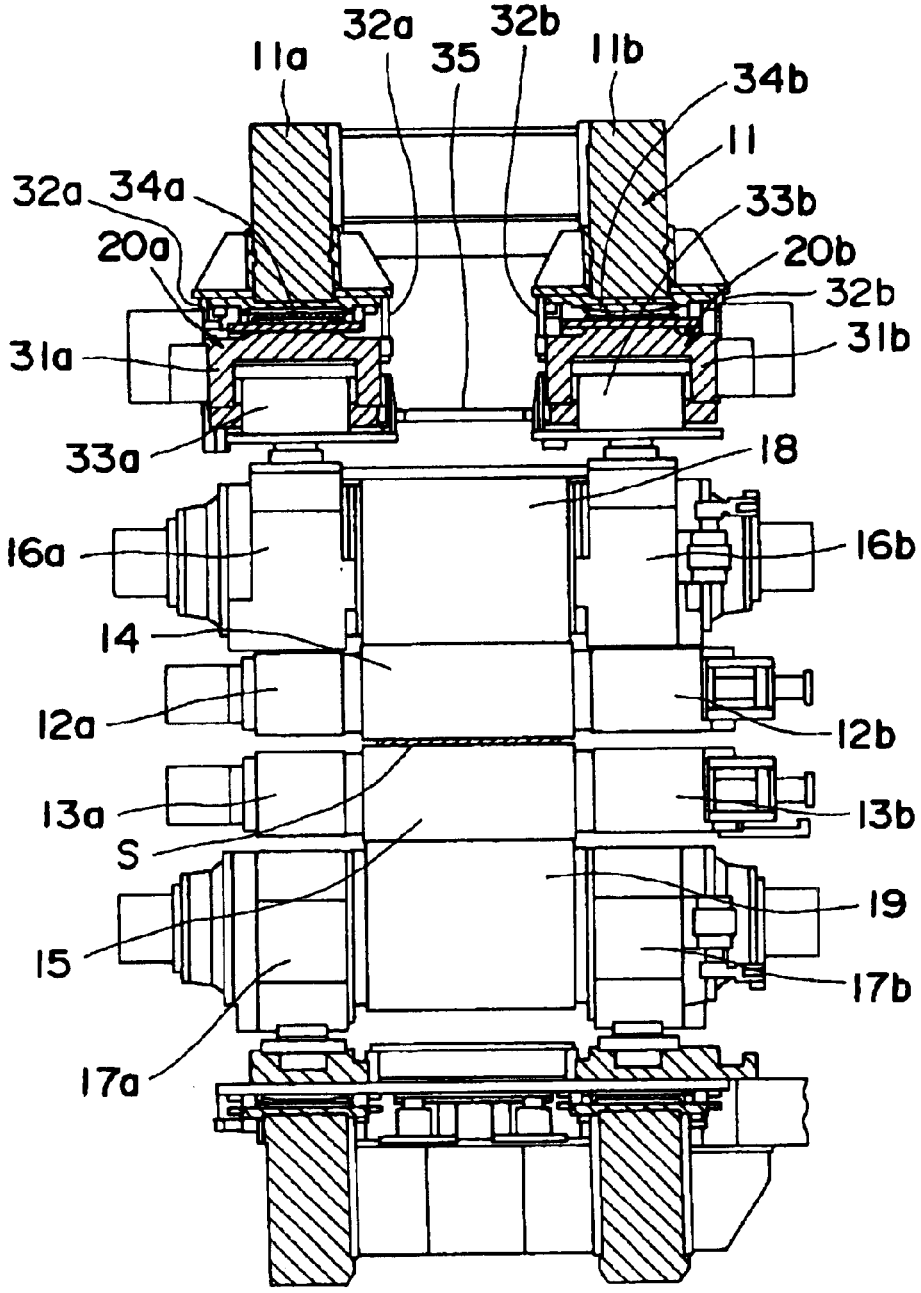
FIG. 4 is a partial cutaway front view of the cross rolling mill.

The above-described four high cross rolling mill of the first embodiment is described in detail. As shown in FIGS. 2 to 4, the housing 11 comprises right and left frames 11*a* and 11*b* as a pair. Right and left upper work roll chocks 12*a* and 12*b* are supported at upper portions of the frames 11*a* and 11*b*, while right and left lower work roll chocks 13*a* and 13*b* are supported at lower portions of the frames 11*a* and 11*b*. Shaft portions of upper and lower work rolls 14 and 15 are rotatably supported by the upper and lower work roll chocks 12*a*, 12*b*, 13*a* and 13*b*.

Right and left upper backup roll chocks 16*a* and 16*b* are supported at the upper portions of the frames 11*a* and 11*b* of the housing 11, and located above the upper work roll chocks 12*a* and 12*b*. Right and left lower backup roll chocks 17*a* and 17*b* are supported at the lower portions of the frames 11*a* and 11*b* of the housing 11, and located below the lower work roll chocks 13*a* and 13*b*. Shaft portions of upper and lower backup rolls 18 and 19 are rotatably supported by the upper and lower backup roll chocks 16*a*, 16*b*, 17*a* and 17*b*.

Furthermore, right and left screw down cylinders 20*a* and 20*b* constituting the screw down device 20 are provided in the upper portions of the frames 11*a* and 11*b* of the housing 11 and located above the upper backup roll chocks 16*a* and 16*b*. In the screw down cylinders 20*a* and 20*b*, cylinder cases 31*a* and 31*b* are suspended and supported by suspending rods 32*a* and 32*b* at the upper portions of the frames 11*a* and 11*b*. Pistons 33*a* and 33*b* are supported within the cylinder cases 31*a* and 31*b* so as to be movable upward and downward. Thus, even when the upper backup roll chocks 16*a* and 16*b* are withdrawn axially together with the upper work roll chocks 12*a* and 12*b* during roll changing, the screw down cylinders 20*a* and 20*b* do not become detached.

A flat bearing 34*a* and a conical roller bearing 34*a* are interposed between the frames 11*a*, 11*b* and the cylinder cases 31*a*, 31*b*, and the cylinder cases 31*a* and 31*b* are connected together by connecting rods 35. Lower surfaces of the pistons 33*a* and 33*b* are in contact with upper surface portions of the right and left upper backup roll chocks 16*a* and 16*b*. The positions of the members are set such that the centers of the pistons 33*a* and 33*b* in the screw down cylinders 20*a* and 20*b* press proper positions of the upper backup roll chocks 16*a* and 16*b* corresponding to the shaft center of the upper backup roll 18.

Balance cylinders 43 are mounted on intermediate portions of the frames 11*a* and 11*b* to enable the right and left upper backup roll chocks 16*a* and 16*b* to be pushed up. During rolling of the strip S, the balance cylinders 43 push up the upper backup roll chocks 16*a* and 16*b* to bear the weights of the upper backup roll chocks 16*a*, 16*b*, upper backup roll 18, and screw down cylinders 20*a*, 20*b*, thereby canceling out the weights of the respective devices so as not to affect the rolling accuracy of the strip S.

The upper crosshead 21 is located in the upper portion of the frame 11*a* of the housing 11 and provided on the delivery side of the housing 11. The hydraulic cylinder mechanisms 23, 24, 25 are located in the upper portion of the frame 11*a* of the housing 11 and provided on the entry side of the housing 11. In this case, the cylinder case 31*b*, upper backup roll chock 16*b*, and upper work roll chock 12*b* on the drive side are supported by spherical bearings 36 so as to be pivotable about a vertical axis relative to the frame 11*b*. The cylinder case 31*a*, upper backup roll chock 16*a*, and upper work roll chock 12*a* on the work side are pushed toward the upper crosshead 21 by the hydraulic cylinder mechanisms 23, 24, 25, and are supported so as to be movable along the transport direction of the strip S, integrally with the frame 11*a*, by the upper roll cross mechanism 22 via the upper crosshead 21.

In the upper roll cross mechanism 22, a cross drive motor 37 is attached to the upper portion of the frame 11*a* of the housing 11, and a drive rod 38 is connected to an output shaft of the cross drive motor 37. Upper and lower worm reduction gears 39 and 40 are mounted on a side portion of the frame 11*a*, and a lower end portion of the drive rod 38 is drivingly connected to the worm reduction gears 39 and 40. Front end portions of driven rods 41 and 42 having base end portions drivably connected to the warm reduction gears 39 and 40 are connected to the upper crosshead 21. Thus, the cylinder case 31*a*, upper backup roll chock 16*a* and upper work roll chock 12*a* are pressed against the upper crosshead 21 by the hydraulic cylinder mechanisms 23, 24, 25. Also, the upper crosshead 21 is moved along the transport direction of the strip S by the driving of the cross drive motor 37 via the drive rod 38, worm reduction gears 39, 40 and driven rods 41, 42. In this manner, the cylinder case 31*a*, upper backup roll chock 16*a* and upper work roll chock 12*a* can be moved in synchronism.

The hydraulic cylinder mechanisms 23, 24, 25 also press the cylinder case 31*a*, upper backup roll chock 16*a* and upper work roll chock 12*a* against the housing 11 via the upper crosshead 21 along the transport direction of the strip S. Consequently, the inward narrowing deformation amount δ of the housing 11 in response to the screw down load is decreased, and the horizontal dynamic stiffness of the rolling mill is kept high. Thus, mill vibrations during rolling can be prevented. The cylinder cases 31*a*, 31*b* are provided with detection sensors 44*a*, 44*b* which detect the amounts of movement of the screw down cylinders 20*a*, 20*b* when the crossing angle is set by the upper roll cross mechanism 22 and hydraulic cylinder mechanisms 23, 24, 25.

The lower crosshead 26 is located in the lower portion of the frame 11*b* of the housing 11 and provided on the delivery side of the housing 11. The hydraulic cylinder mechanisms 28, 29 are located in the lower portion of the frame 11*b* of the housing 11 and provided on the entry side of the housing 11. In this case, the lower backup roll chock 17*a*, and lower work roll chock 13*a* on the work side are supported by spherical bearings (not shown) so as to be pivotable about a vertical axis relative to the frame 11*a*. The lower backup roll chock 17*b* and lower work roll chock 13*b* on the drive side are thrust against the lower crosshead 26 by the hydraulic cylinder mechanisms 28, 29, and are supported so as to be movable along the transport direction of the strip S, integrally with the frame 11*b*, by the lower roll cross mechanism 27 via the lower crosshead 26.

The lower roll cross mechanism 27 has practically the same configuration as that of the aforementioned upper roll cross mechanism 22 (its explanation is omitted). Thus, the lower crosshead 26 is moved along the transport direction of the strip S by the action of the lower roll cross mechanism 27 and hydraulic cylinder mechanisms 28, 29, and the lower backup roll chock 17*b* and lower work roll chock 13*b* can be moved in synchronism. Moreover, the hydraulic cylinder mechanisms 28, 29 press the lower backup roll chock 17*b* and lower work roll chock 13*b* against the housing 11 via the lower crosshead 26 along the transport direction of the strip S. Consequently, mill vibrations during rolling can be prevented.

In setting the crossing angle in the cross rolling mill of the present embodiment described above, the upper roll cross mechanism 22 is actuated to move the upper crosshead 21. This movement results in the movement of the screw down cylinder 20*a*, upper backup roll chock 16*a* and upper work roll chock 12*a*, which have been pressed against the upper crosshead 21 by the hydraulic cylinder mechanisms 23, 24, 25. The lower roll cross mechanism 27 is also actuated to move the lower crosshead 26, thereby moving the lower backup roll chock 17*b* and lower work roll chock 13*b* which have been pressed against the lower crosshead 26 by the hydraulic cylinder mechanisms 28, 29. As a result, the upper work roll 14 and upper backup roll 18, and the lower work roll 15 and lower backup roll 19 have their axes of rotation crossed, and the crossing angle can be set at a predetermined angle.

When rolling is to be performed at the set crossing angle, the screw down device 20 is actuated for the strip S which is fed from the entry side of the housing 11 and passed between the upper work roll 14 and the lower work roll 15. As a result, the pressing force of the screw down device 20 is imposed, as a predetermined load, on the strip S via the upper backup roll chocks 16*a*, 16*b*, upper backup roll 18 and upper work roll 14 to roll the strip S to a predetermined plate thickness.

In this case, the screw down cylinder 20*a*, upper backup roll chock 16*a* and upper work roll chock 12*a* are synchronously moved by the upper roll cross mechanism 22 and hydraulic cylinder mechanisms 23, 24, 25 via the upper crosshead 21 at the time of setting the crossing angle. Thus, a positional set state in which the centers of the pistons 33*a*, 33*b* in the screw down cylinders 20*a*, 20*b* align with the shaft center of the upper backup roll 18 (upper work roll 14) is maintained. Hence, the screw down cylinders 20*a*, 20*b* press the proper positions of the upper backup roll chocks 16*a*, 16*b*, thus preventing the occurrence of a tipping moment in the upper backup roll chocks 16*a*, 16*b*. Consequently, a predetermined rolling load is properly imposed on the strip S, and stable rolling is performed, whereby the strip S can be rolled with high accuracy.

Since no tipping moment occurs in the upper backup roll chocks 16*a*, 16*b*, one-side contact does not occur between the screw down cylinders 20*a*, 20*b* and the upper backup roll chocks 16*a*, 16*b*, and the decrease in the life of the screw down device 20 due to partial wear can be prevented.

Even when the roll cross angle is to be changed during rolling of the strip S, the screw down cylinder 20*a*, upper backup roll chock 16*a* and upper work roll chock 12*a* are synchronously moved by the upper roll cross mechanism 22 and hydraulic cylinder mechanisms 23, 24, 25 via the upper crosshead 21. Thus, the screw down cylinders 20*a*, 20*b* constantly press the proper position of the upper backup roll chocks 16*a*, 16*b* in the same manner as described above, so that stable rolling of the strip S can be carried out.

With the cross rolling mill of the present embodiment, as described above, the screw down device 20 (screw down cylinders 20*a*, 20*b*) is synchronously moved in the same direction, together with the upper chocks 12*a*, 16*a* (upper rolls 14, 18), via the upper crosshead 21 by the actuation of the upper roll cross mechanism 22 and the thrusting of the screw down cylinder 20*a*, upper backup roll chock 16*a* and upper work roll chock 12*a* against the upper crosshead 21 by the hydraulic cylinder mechanisms 23, 24, 25. Thus, the screw down device 20 presses the proper position of the upper backup roll chock 16 corresponding to the shaft center of the upper backup roll 18, with the positional relationship between the screw down device 20 and the upper rolls 14, 18 being retained. Consequently, stable rolling takes place constantly, so that the rolling accuracy of the strip S can be improved, and the decrease in the life of the screw down device 20 due to partial wear can be prevented.

In the foregoing embodiment, the upper roll cross mechanism 22 is composed of the cross drive motor 37, worm reduction gears 39, 40, etc. However, this structure is not restrictive, and a cross drive motor and screw shafts may be used, or hydraulic cylinders may be used. The hydraulic cylinder mechanisms 23, 24, 25 may be other mechanical moving mechanisms. Moreover, the roll moving means and screw down moving means of the present invention are embodied by the upper roll cross mechanism 22 and hydraulic cylinder mechanisms 23, 24, 25. However, the roll moving means may be the upper roll cross mechanism 22 and hydraulic cylinder mechanisms 24, 25, while the screw down moving means may be other mechanical moving mechanisms or hydraulic moving mechanisms.

In the foregoing embodiment, moreover, the rolling mill of the present invention is described as a four high cross rolling mill of a unilateral cross type. However, the invented rolling mill may be a cross rolling mill of a bilateral cross type having crossheads and roll cross mechanisms for right and left roll chocks. The type of the rolling mill is not limited to a cross rolling mill, and the invention is applicable to a shift rolling mill or an offset rolling mill.

Second Embodiment

Figure 5:
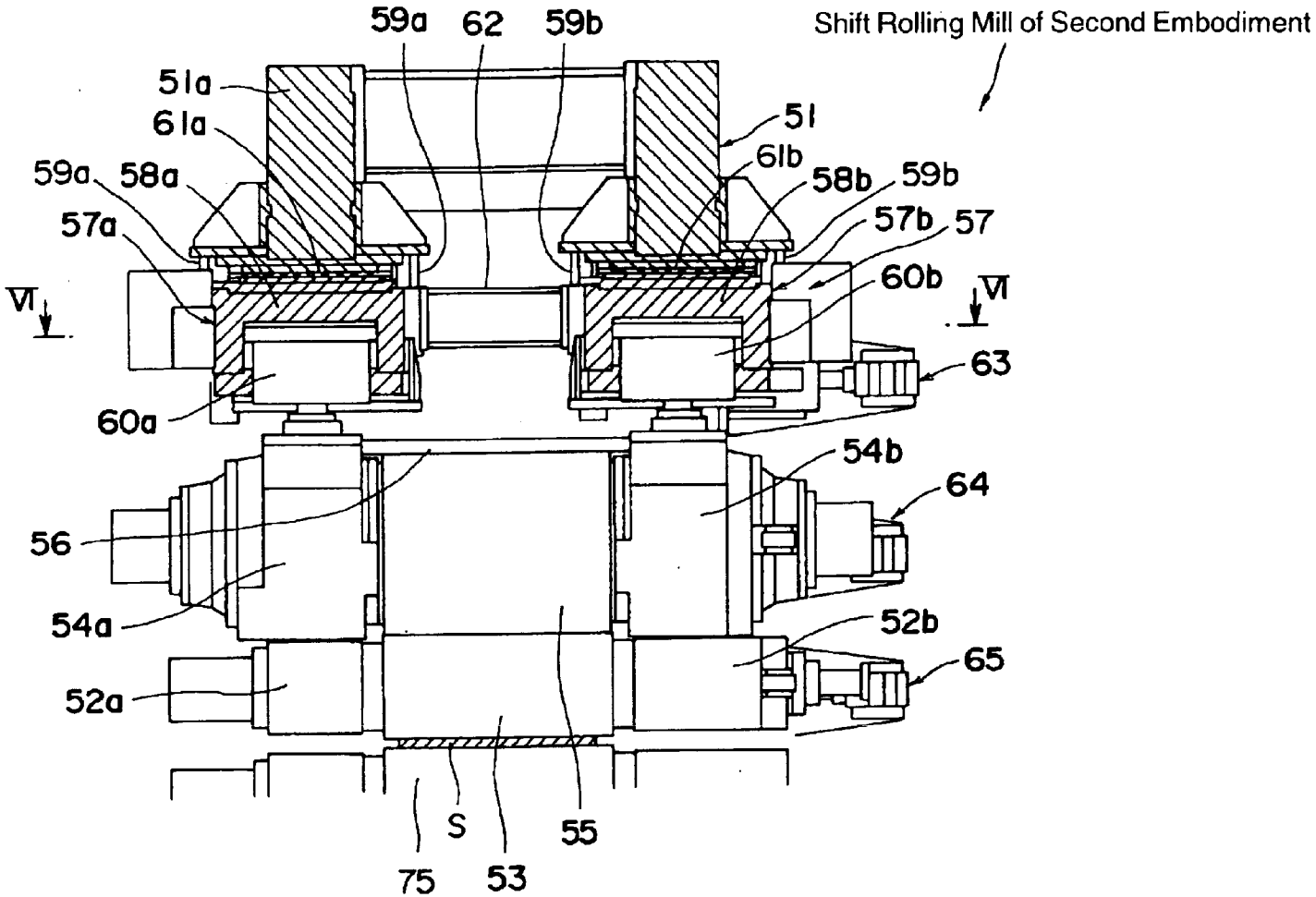
FIG. 5 is a partial cutaway front view of a shift rolling mill as a rolling mill according to a second embodiment of the present invention.
Figure 6:
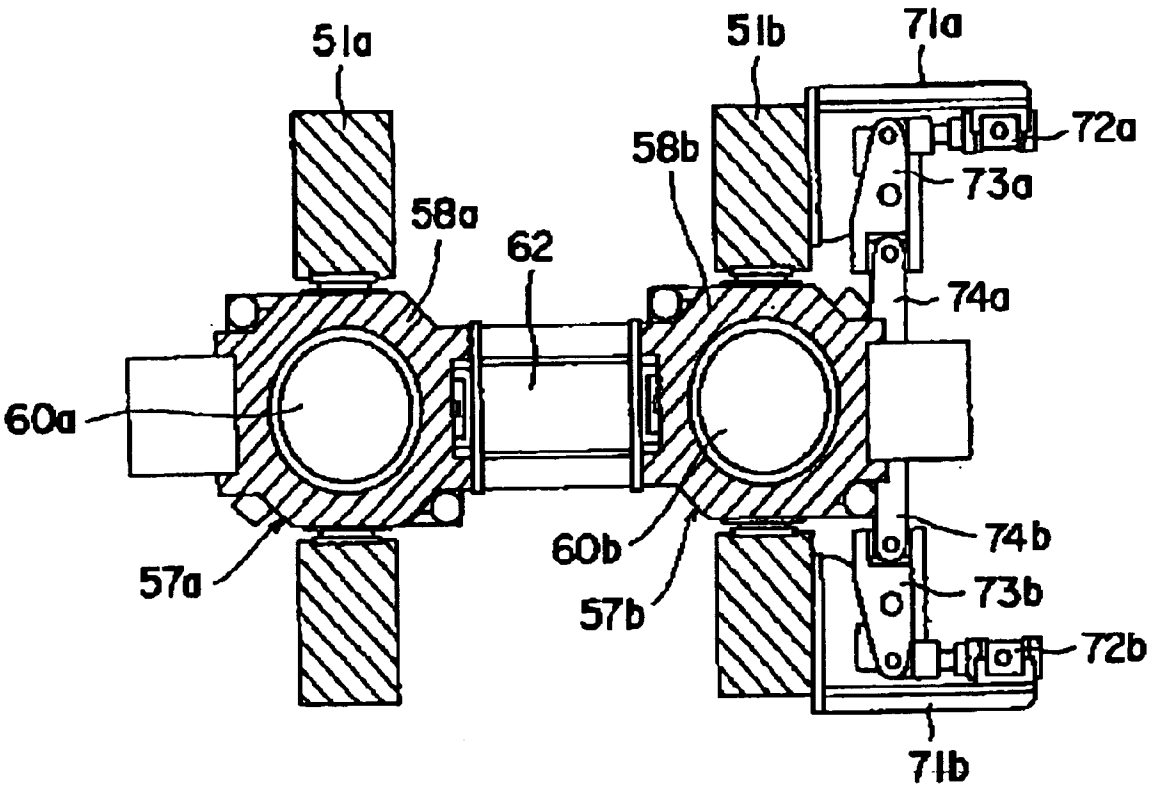
FIG. 6 is a sectional view taken along line VI—VI of FIG. 5.

A rolling mill according to a second embodiment is a shift rolling mill in which upper and lower work rolls can be shifted in the roll axis direction. In this shift rolling mill, as shown in FIGS. 5 and 6, an upper work roll 53 is rotatably supported by a housing 51 (frames 51*a*, 51*b*) via right and left upper work roll chocks 52*a* and 52*b*. An upper backup roll 55 is rotatably supported by the housing 51 via right and left upper backup roll chocks 54*a* and 54*b*, and is opposed to and contacted with the upper work roll 53. The right and left upper backup roll chocks 54*a* and 54*b* are connected by connecting rods 56.

Furthermore, screw down cylinders 57*a*, 57*b* constituting a screw down device 57 are provided in an upper portion of the housing 51 and located above the upper backup roll chocks 54*a*, 54*b*. In the screw down cylinders 57*a*, 57*b*, cylinder cases 58*a*, 58*b* are suspended and supported by suspending rods 59*a*, 59*b* at the upper portion of the housing 51, and pistons 60*a*, 60*b* are supported so as to be movable upward and downward. Flat bearings 61*a*, 61*b* are interposed between the housing 51 and the cylinder cases 58*a*, 58*b*, and the cylinder cases 58*a* and 58*b* are connected together by connecting members 62. Lower surfaces of the pistons 60*a*, 60*b* are in contact with upper surface portions of the right and left upper backup roll chocks 54*a* and 54*b*. The positions of these members are set such that the screw down cylinders 57*a* and 57*b* are provided symmetrically in the axial direction with respect to the upper backup roll 55 (upper work roll 53), and press the upper backup roll 55 (upper work roll 53) in a laterally balanced manner via the upper backup roll chocks 54*a*, 54*b*.

The screw down cylinders 57*a*, 57*b*, upper backup roll chocks 54*a*, 54*b* (upper backup roll 55), and upper work roll chocks 52*a*, 52*b* (upper work roll 53) are movable in the roll axis direction by upper shift cylinders 63 (screw down moving means) and 64, 65 (roll moving means). The shift cylinders 63, 64, 65 will be described below, but since they have practically the same configuration, an explanation is offered for the shift cylinder 63 alone.

A pair of hydraulic cylinders 72*a* and 72*b* constituting the upper shift cylinder 63 and symmetrical to each other are mounted on the entry side and the delivery side of the frame 51*b* of the housing 51 by mounting brackets 71*a* and 71*b*. End portions of pivotable operating levers 73*a* and 73*b* are connected to the hydraulic cylinders 72*a* and 72*b*. Connecting flanges 74*a*, 74*b* are attached to the cylinder case 58*b* of the screw down cylinder 57*b*, and end portions of the connecting flanges 74*a*, 74*b* are in engagement with other end portions of the operating levers 73*a*, 73*b*. Thus, when the hydraulic cylinders 72*a*, 72*b* are synchronously actuated to pivot the operating levers 73*a*, 73*b* in the opposite direction, the screw down cylinders 57*a*, 57*b* can be moved in the roll axis direction via the connecting flanges 74*a*, 74*b*.

In the shift rolling mill, only the upper work roll 53, upper backup roll 55 and screw down device 57 provided in the upper portion of the housing 51 have been described. A lower work roll 75, and a lower backup roll (not shown) are provided so as to be opposed to the upper work roll 53 and upper backup roll 55. The lower work roll 75 and lower backup roll are movable in the roll axis direction by lower shift cylinders (not shown) provided on the frame 51*a*.

When shift positions of the upper and lower work rolls 53 and 75 are to be set by the above-described shift rolling mill of the present embodiment, the upper shift cylinders 63, 64, 65 are synchronously actuated to move the screw down cylinders 57*a*, 57*b*, upper backup roll chocks 54*a*, 54*b* and upper work roll chocks 52*a*, 52*b* in one roll axis direction. Whereas the lower shift cylinders are synchronously actuated to move the lower backup roll chocks and lower work roll chocks in the other roll axis direction. By so doing, the shift positions of the upper and lower work rolls 53 and 75 can be set at predetermined positions.

On this occasion, the screw down cylinders 57*a*, 57*b*, upper backup roll chocks 54*a*, 54*b* and upper work roll chocks 52*a*, 52*b* are synchronously moved in the roll axis direction by the upper shift cylinders 63, 64, 65. Thus, the screw down cylinders 57*a*, 57*b* can press the proper positions of the upper backup roll chocks 54*a*, 54*b* in a constantly balanced manner. During rolling of a strip S, therefore, a predetermined rolling load acts properly on the strip S, ensuring stable rolling. Hence, the strip S can be rolled with high accuracy.

In the above-described embodiment, the upper shift cylinder 63 is provided as the screw down moving means of the present invention, and the upper shift cylinders 64, 65 are provided as the roll moving means. However, one shift cylinder may be adapted to move the screw down cylinders 57*a*, 57*b*, upper backup roll chocks 54*a*, 54*b* and upper work roll chocks 52*a*, 52*b* synchronously in the roll axis direction.

When the rolling mill of the present invention is applied to an offset rolling mill, the roll moving means and screw down moving means may be offset cylinders for moving the roll chocks and screw down device in the transport direction of the strip.

Third Embodiment

In a four high cross rolling mill according to a third embodiment, first balance cylinders provided at an intermediate portion of a housing 11 push up upper backup roll chocks 16*a*, 16*b* and an upper backup roll 18 to bear their weights. Whereas second balance cylinders provided at an upper portion of the housing 11 suspend screw down cylinders 20*a*, 20*b*, which constitute a screw down device 20, to bear their weights.

Figure 7:
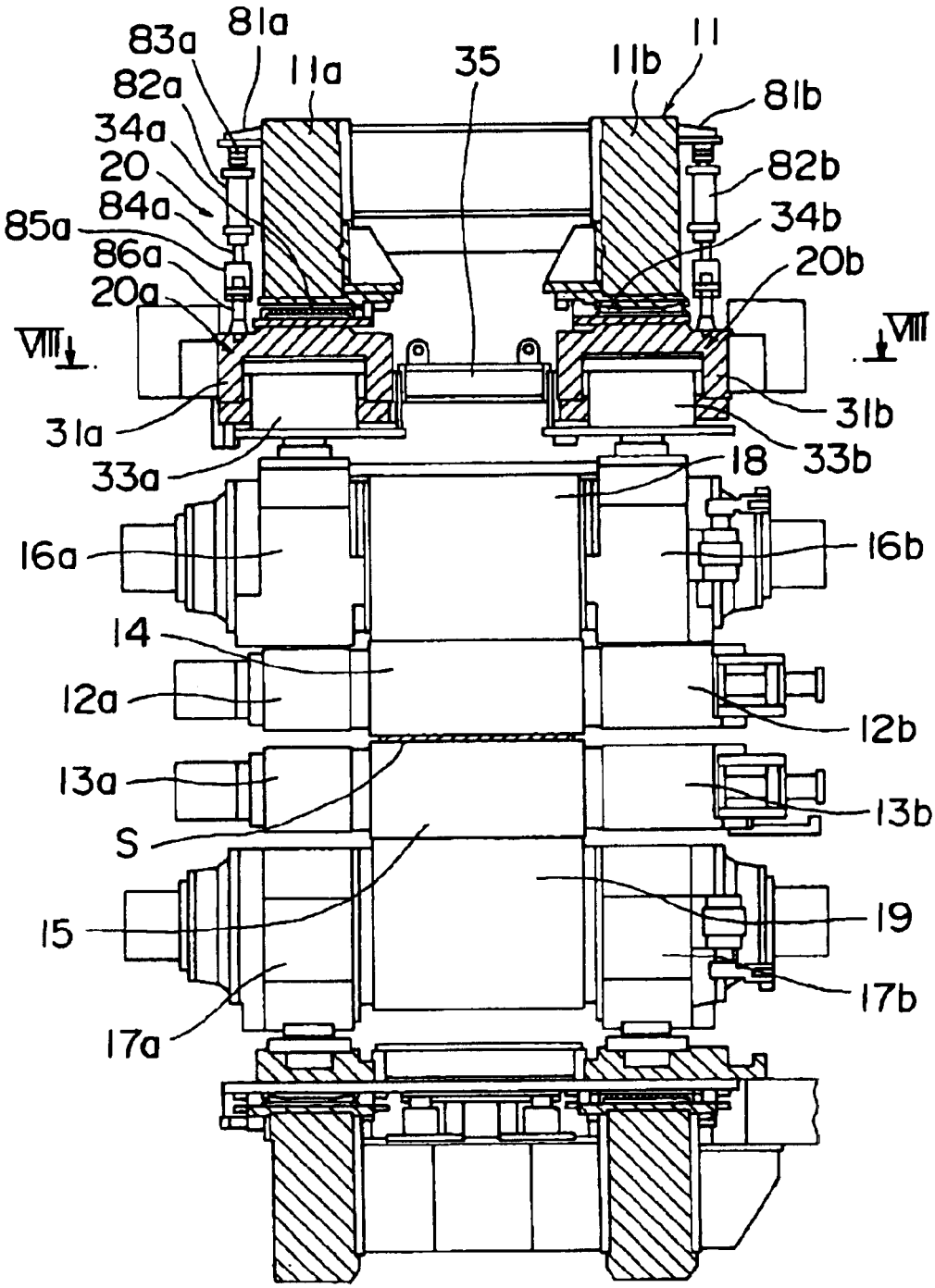
FIG. 7 is a partial cutaway side view of a cross rolling mill as a rolling mill according to a third embodiment of the present invention.
Figure 8:
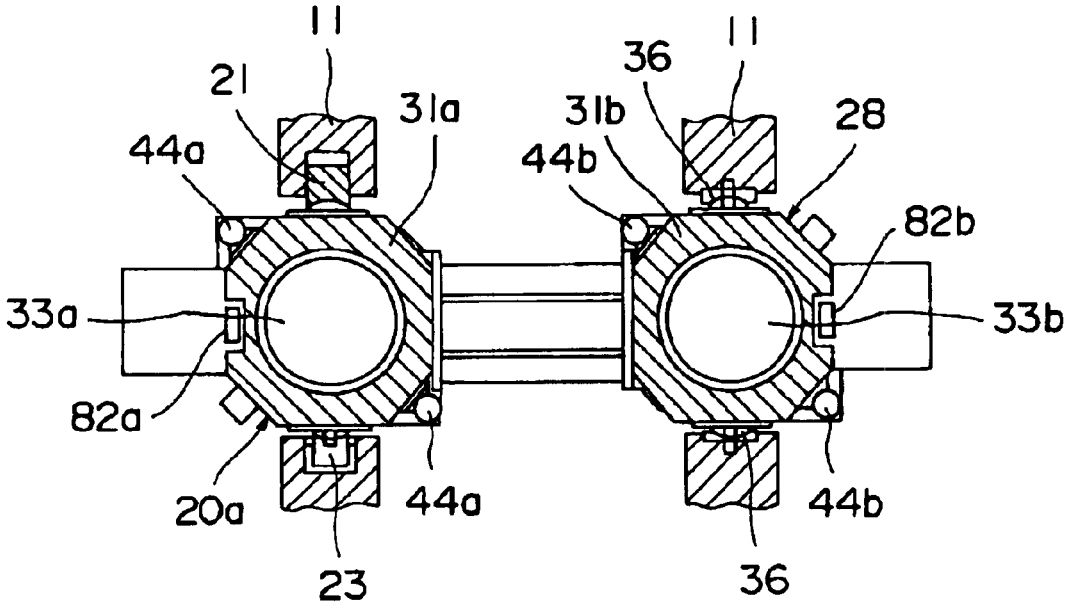
FIG. 8 is a sectional view taken along line VIII—VIII of FIG. 7.
Figure 9:
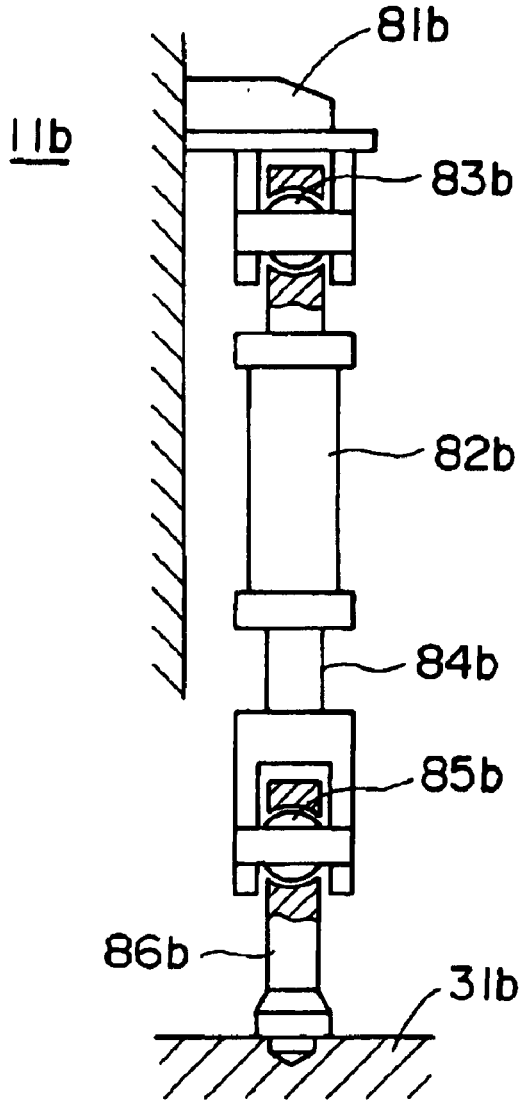
FIG. 9 is a detail drawing of a balance cylinder for a screw down device as a partial cutaway front view of the cross rolling mill.
Figure 10:
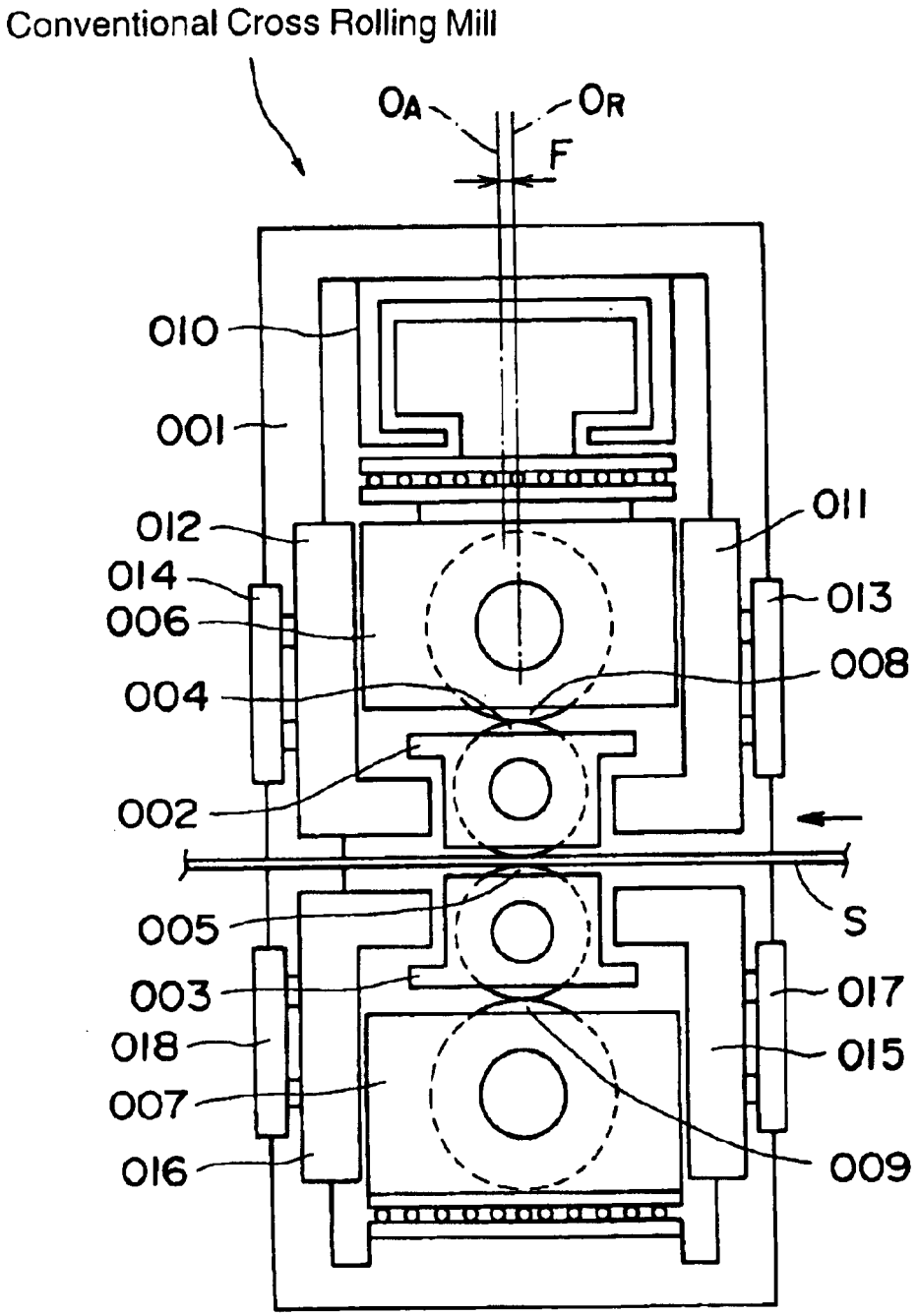
FIG. 10 is a schematic view of a conventional four high cross rolling mill.

That is, as shown in FIGS. 7 and 8, mounting brackets 81*a*, 81*b* are attached to upper portions of frames 11*a*, 11*b* of the housing 11. Second balance cylinders 82*a*, 82*b* are suspended from and connected to the mounting brackets 81*a*, 81*b* via spherical bushes 83*a*, 83*b*. Connecting rods 86*a*, 86*b* are connected to drive rods 84*a*, 84*b* of the second balance cylinders 82*a*, 82*b* via spherical bushes 85*a*, 85*b*, and the connecting rods 86*a*, 86*b* are attached to cylinder cases 31*a*, 31*b*. During rolling of a strip S, the second balance cylinders 82*a*, 82*b* pull up the screw down cylinders 20*a*, 20*b* to bear the weights of the screw down cylinders 20*a*, 20*b*, thereby canceling out these weights so as not to affect the rolling accuracy of the strip S.

A flat bearing 34*a* and a conical roller bearing 34*b* are interposed between the frames 11*a*, 11*b* and the cylinder cases 31*a*, 31*b*, and the cylinder cases 31*a* and 31*b* are connected together by connecting rods 35. Lower surfaces of pistons 33*a* and 33*b* are in contact with upper surface portions of right and left upper backup roll chocks 16*a* and 16*b*.

First balance cylinders 43 (see FIG. 2) are mounted on intermediate portions of the frames 11*a* and 11*b* to enable the right and left upper backup roll chocks 16*a* and 16*b* to be pushed up. During rolling of the strip S, the balance cylinders 43 push up the upper backup roll chocks 16*a* and 16*b* to bear the weights of the upper backup roll chocks 16*a*, 16*b* and upper backup roll 18, thereby canceling out the weights of the respective devices so as not to affect the rolling accuracy of the strip S.

The four high cross rolling mill of the present embodiment is also equipped with the same roll cross mechanisms 22, 27 and hydraulic cylinder mechanisms 23, 24, 25, 28, 29 as in the aforementioned first embodiment, although these mechanisms are not shown. Since their structures and actions are practically the same, their duplicate explanations are omitted.

In setting the crossing angle in the cross rolling mill of the present embodiment described above, the upper roll cross mechanism 22 and hydraulic cylinder mechanisms 23, 24, 25 are actuated, and the lower roll cross mechanism 27 and hydraulic cylinder mechanisms 28, 29 are also actuated. As a result, the upper work roll 14 and upper backup roll 18, and the lower work roll 15 and lower backup roll 19 have their axes of rotation crossed, and the crossing angle can be set at a predetermined angle.

At this time, the screw down cylinder 20*a*, upper backup roll chock 16*a* and upper work roll chock 12*a* are synchronously moved by the upper roll cross mechanism 22 and hydraulic cylinder mechanisms 23, 24, 25 via the upper crosshead 21. Thus, a positional set state in which the centers of the pistons 33*a*, 33*b* in the screw down cylinders 20*a*, 20*b* align with the shaft center of the upper backup roll 18 (upper work roll 14) is maintained. Hence, the screw down cylinders 20*a*, 20*b* press the proper positions of the upper backup roll chocks 16*a*, 16*b*, thus preventing the occurrence of a tipping moment in the upper backup roll chocks 16*a*, 16*b*. Also, a predetermined rolling load is properly imposed on the strip S, and stable rolling is performed, whereby the strip S can be rolled with high accuracy.

When the roll cross angle is set, the screw down cylinders 20*a*, 20*b* move together with the upper backup roll chocks 16*a*, 16*b* and upper work roll chocks 12*a*, 12*b*. The screw down cylinders 20*a*, 20*b* are suspended from and supported by the frames 11*a*, 11*b* via the second balance cylinders 82*a*, 82*b* and spherical bushes 83*a*, 83*b*, 85*a*, 85*b*. Thus, the amounts of horizontal movements of the screw down cylinders 20*a*, 20*b* relative to the frames 11*a*, 11*b* are absorbed by the spherical bushes 83*a*, 83*b*, 85*a*, 85*b*.

With the cross rolling mill of the present embodiment, as described above, the screw down cylinder 20*a*, upper backup roll chock 16*a* and upper work roll chock 12*a* are synchronously moved in the same direction when the crossing angle is set. Thus, the screw down device 20 presses the proper position, without destroying its positional relationship with the upper rolls 14, 18. Consequently, stable rolling takes place constantly, so that the rolling accuracy of the strip S can be improved, and the decrease in the life of the screw down device 20 due to partial wear can be prevented.

At this time, the amounts of horizontal movements of the screw down cylinders 20*a*, 20*b* relative to the frames 11*a*, 11*b* are absorbed by the spherical bushes 83*a*, 83*b*, 85*a*, 85*b*. Thus, the property of the screw down cylinder 20*a* following the upper backup roll chock 16*a* and the upper work roll chock 12*a* can be improved. When the strip S is rolled, the second balance cylinders 82*a*, 82*b* work, lifting the screw down device 20 (screw down cylinders 20*a*, 20*b*) and bearing its weight. Hence, the weight of the screw down device 20 does not adversely affect the rolling accuracy of the strip S.

While the present invention has been described in the foregoing fashion, it is to be understood that the invention is not limited thereby, but may be varied in many other ways. Such variations are not to be regarded as a departure from the spirit and scope of the invention, and all such modifications as would be obvious to one skilled in the art are intended to be included within the scope of the appended claims.

What is claimed is:

1. A rolling mill, comprising:

a housing;

upper and lower rolling rolls rotatably supported by the housing via roll chocks;

a screw down unit provided in an upper portion of the housing and adapted to apply a predetermined pressure to the rolling roll;

a roll moving unit adapted to move the roll chocks in horizontal planes such that the rolling rolls move in the horizontal planes; and a screw down moving unit adapted to move the screw down unit in a horizontal plane, wherein the roll moving unit and the screw down moving unit are actuated simultaneously, such that the roll chocks and the screw down unit move simultaneously along rotational axes of the rolling rolls.

2. The rolling mill of claim 1, wherein the roll moving unit and the screw down moving unit act as a single synchronous moving unit, and the roll chocks and the screw down unit are adapted to be synchronously moved by the synchronous moving unit.

3. The rolling mill of claim 1, wherein the screw down unit includes hydraulic cylinders, supported by the upper portion of the housing so as to be movable in the horizontal plane.

4. The rolling mill of claim 1, wherein the rolling mill moves the roll chocks forward and rearward in a transport direction of a strip material, and the roll chocks supports the upper and lower rolling rolls, thereby causing central axes of the rolls to cross each other, the rolling mill further comprising:

a roll cross unit adapted to move the roll chocks to cross the upper and lower rolling rolls, the roll cross unit including the roll moving means and the screw down moving means.

5. The rolling mill of claim 4, wherein the roll cross unit is a crosshead for supporting the roll chocks and the screw down unit, such that the roll chocks and the screw down unit are movable in the transport direction of the strip material.

6. The rolling mill of claim 4, wherein the roll cross unit includes a mechanical moving mechanism provided on one of an entry side and a delivery side of the strip material in the roll chocks, and a hydraulic moving mechanism provided on the other of the entry side and the delivery side.

7. The rolling mill of claim 4, wherein the rolling rolls include upper and lower work rolls rotatably supported by the housing vie work roll chocks and opposed to each other, and upper and lover backup rolls rotatably supported by the housing via backup roll chocks and opposed to and contacted with the upper and lower work rolls, and the roll cross unit moves the work roll chocks and the backup roll chocks by the crosshead.

8. The rolling mill of claim 1, wherein, the rolling rolls includes upper and lower work rolls rotatably supported by the housing via work roll chocks and opposed to each other, and upper and lower backup rolls rotatably supported by the housing via backup roll chocks and opposed to and contacted with the upper and lower work rolls, the backup rolls opposed to and contacted with the work rolls are displaced in a transport direction of a strip material, and the roll moving unit and the screw down moving unit are offset move the roll chocks and the screw down unit in the transport direction of the strip material.

9. The rolling mill of claim 1, wherein the screw down moving unit includes, a screw down cylinder that accommodates a screw down cylinder, and an actuator supported by the housing for moving the screw down cylinder along the rotational axes of the rolling rolls.

10. The rolling mill of claim 9, wherein the screw down moving unit further includes, a lever pivotally supported by the housing, a first end of the lever being connected to the actuator, and a second end of the lever being connected to the screw down cylinder.

11. The rolling mill of claim 1, wherein the screw down moving unit includes, a screw down cylinder that accommodates a screw down cylinder, and a first actuator supported by the housing, and a second actuator supported by the housing, the first actuator and the second actuator act simultaneously to move the screw down cylinder along the rotational axes of the rolling rolls.

12. The rolling mill of claim 11, wherein the screw down moving unit further includes, a first lever pivotally supported by the housing, a first end of the first lever being connected to the first actuator, and a second end of the first lever being connected to the screw down cylinder, and a second lever pivotally supported by the housing, a first end of the second lever being connected to the second actuator, and a second end of the second lever being connected to the screw down cylinder.

* * * * *